US005152665A

United States Patent [19]

Huang

[11] Patent Number: 5,152,665

[45] Date of Patent: Oct. 6, 1992

[54] METHODS AND APPARATUS FOR REDUCING INLET SLEEVE VIBRATION

[75] Inventor: Kuo P. Huang, Winter Springs, Fla.

[73] Assignee: Westinghouse Electric Corporation, Pittsburgh, Pa.

[21] Appl. No.: 632,789

[22] Filed: Dec. 24, 1990

[51] Int. Cl.[5] ..... F01D 25/26

[52] U.S. Cl. ..... 415/134; 415/108

[58] Field of Search ..... 415/134, 108, 136, 137, 415/138

[56] References Cited

U.S. PATENT DOCUMENTS

| | | | |
|---|---|---|---|
| 3,628,878 | 12/1971 | Trassel et al. | 415/108 |
| 4,029,432 | 6/1977 | Meylan et al. | 415/108 |
| 4,177,003 | 12/1979 | Remberg et al. | 415/108 |
| 4,362,464 | 12/1982 | Stock | 415/108 |
| 4,832,566 | 5/1989 | Martin | 415/119 |
| 5,037,270 | 8/1991 | Bangel et al. | 415/108 |

FOREIGN PATENT DOCUMENTS

| | | | |
|---|---|---|---|
| 1010072 | 6/1957 | Fed. Rep. of Germany | 415/108 |
| 661822 | 11/1951 | United Kingdom | 415/108 |

*Primary Examiner*—John T. Kwon

[57] ABSTRACT

The present invention substantially reduces the likelihood of cracking failure occurring in the inlet sleeves which connect a steam source to the outer cylinder of a steam turbine. The present invention eliminates the excessive vibration which is the fundamental cause of cyclic stresses which cause fatigue cracking. The present invention minimizes vibration by limiting the amplitude of the sleeve's oscillations of the inlet sleeve by preferably restraining the sleeve within a structure such as a disc having grooves cut therein which engage splines formed on the inlet sleeve. The present invention provides sufficient clearance for installation but reduces the amplitude of radial oscillations. The present invention thus allows free vertical and radial sleeve movement of the inlet sleeve, but limits random vibration that caused highcycle vibrations. The present invention limits sleeve vibration in all directions, but does not introduce undesirable thermal stresses, while providing adequate cold clearance for installation ease. Methods of assembling steam turbines are also disclosed.

13 Claims, 3 Drawing Sheets

METHODS AND APPARATUS FOR REDUCING INLET SLEEVE VIBRATION

BACKGROUND OF THE INVENTION

The present invention relates to steam turbines, and more specifically relates to structures for connecting a source of steam to the inner cylinder of a steam turbine.

Cracking failures in the inlet sleeves of fossil steam turbines have been a significant problem for almost two decades. Over the last 15–20 years, the assignee of the present invention is aware of over 100 cases of cracking that have occurred in its turbines. Obviously, such cracking is detrimental to the steam turbine and results in increased downtime and maintenance, thereby increasing the costs of operating the steam turbine. It would therefore be desireable to identify the phenomena which contribute to such cracking and reduce or eliminate them.

FIG. 1 illustrates a typical fossil turbine 100, the inner cylinder 101, and the outer cylinder 102 to which the inlet sleeve 104 is connected. As shown by the arrows, steam flows through the inlet sleeve 104, into the inner cylinder 101 of the turbine 100, where it encounters a series of blades 105, which induce rotation in the output shaft 110. The operation and various constructions of the blades 105 and other portions of a steam turbine 100 are well known to those of ordinary skill. For purposes of the present invention, the details of the inlet sleeve 104, its connection to the outer cylinder 102, as well as the thermal and bending stresses generated within these components during operation are of primary concern.

As illustrated in cross-section in FIG. 2, in prior designs the inlet sleeve 10 is typically connected to a flexible skirt 108, which forms part of the outer cylinder 102, using a circumferential weld 106. In the failures mentioned above, cracks 51 usually occur near the inside trepan radius 53 at the fixed end 103 of the inlet sleeve 104. Metallurgical examination indicates that failures due to cracks 51 such as those illustrated have been caused by high cycle fatigue, induced by reverse bending stresses. Flow-excited vibration brings about these failures by creating the reverse bending stresses. When the structure vibrates at its resonant frequency, the cantilevered free end 109 oscillates with increasingly large amplitudes, producing alternating bending stresses at the fixed end 103. As shown by the crack 51 at the initiation site illustrated, when these stresses exceed the endurance limit of the sleeve material, fatigue cracking failures occur and will most likely occur in the manner illustrated.

One means of addressing the cracking problem is to increase the trepan radius 53 adjacent to the site of the cracks 51. Although this solution lowers the stress concentration factor in the region in which the cracks are typically initiated, failures have been shown to continue at an unacceptably high level even with the larger radius 53. Since the fundamental cause of the cracking problem is the unrestrained movement at the free end 109 of the sleeve 104, which permits excessive vibration, another means of addressing the problem would be to anchor, or otherwise fix, the free end 109 of the sleeve 104 to prevent this oscillation. However, the free end 109 cannot be anchored to the steam turbine structure since a sliding joint within the inner cylinder 101 is necessary. The free end 109 cannot be attached to the outer cylinder 102, because unacceptable thermal stresses would result from the temperature differential.

Another possible solution to this problem would be to reduce the cold clearance "c" between the inlet sleeve 104 and the inner surface of the outer cylinder 102 to restrict movement. This is not a viable solution, however, since it would not allow for sufficient thermal expansion during operation, and could fracture the sleeve 104. On the other hand, too large a clearance "c" would render the structure totally ineffective for restraining the vibration.

Thus, the unique geometric, vibrational and heat transfer characteristics of the steam inlet/outer cylinder junction have posed a problem which has defied solution by conventional engineering modifications. As pointed out above, the importance of eliminating the vibration and resulting stresses at this joint cannot be overstated. It would be desirable, however, to provide a solution to the problem that does not add an undue degree of complexity to the turbine assembly.

SUMMARY OF THE INVENTION

Accordingly, it has now been found that in a steam turbine comprising an outer cylinder and an inlet sleeve for receiving and transmitting steam a restraining structure may be affixed to the outer cylinder for engaging the restraining structure affixed to the inlet sleeve. The engagement of the restraining structure and the means for engaging it substantially restrain the inlet sleeve from radial deflection an yet unrestrained from axial movement. Preferably, the restraining structure comprises one or more ridges oriented along the axis of the inlet sleeve, most preferably in the form of a substantially square spline. The restraining structure preferably comprises a disc with a plurality of circumferentially disposed grooves along its inner edge. The outer edge is affixed to the outer cylinder. Similarly, the means for engaging the restraining structure preferably comprise splines which cooperate with the grooves to form a sliding fit therewith which are most preferably disposed circumferentially the outer surface of the inlet sleeve.

Therefore, the present invention provides a steam turbine comprising an outer cylinder which has a first restraining means and an inlet sleeve for receiving and transmitting steam which has a second, cooperating restraining means. The inlet sleeve is restrained from substantial radial deflection and unrestrained from axial motion by the engagement of these restraining means.

The present invention also provides methods of assembling a steam turbine which comprise an inlet sleeve and an outer cylinder into which the inlet sleeve is connected. Preferably a plurality of restraining means disposed upon the inlet sleeve are provided. A restraining structure having a plurality of grooves for engaging the restraining means is then affixed to the outer cylinder and the inlet sleeve is slid into engagement with the grooves.

DETAILED DESCRIPTION OF THE PREFERRED EMBODIMENT

The present invention solves the problem of cracking failures in the inlet sleeve of a steam turbine by eliminating the excessive vibration which is its fundamental cause. The design of the present invention minimizes vibration by limiting the range of oscillating movement at operating temperatures, while providing sufficient cold clearance for installation. In a preferred embodiment the present invention restricts the oscillating movement of the sleeve end by providing a restraining structure affixed to the outer cylinder, which is most preferably in the form of a disc. The inlet sleeve preferably passes through the inner opening of the disc and is preferably restrained by the engagement of structural portions, such as splines, disposed on the sleeve and grooves in the disc.

Figure 1:
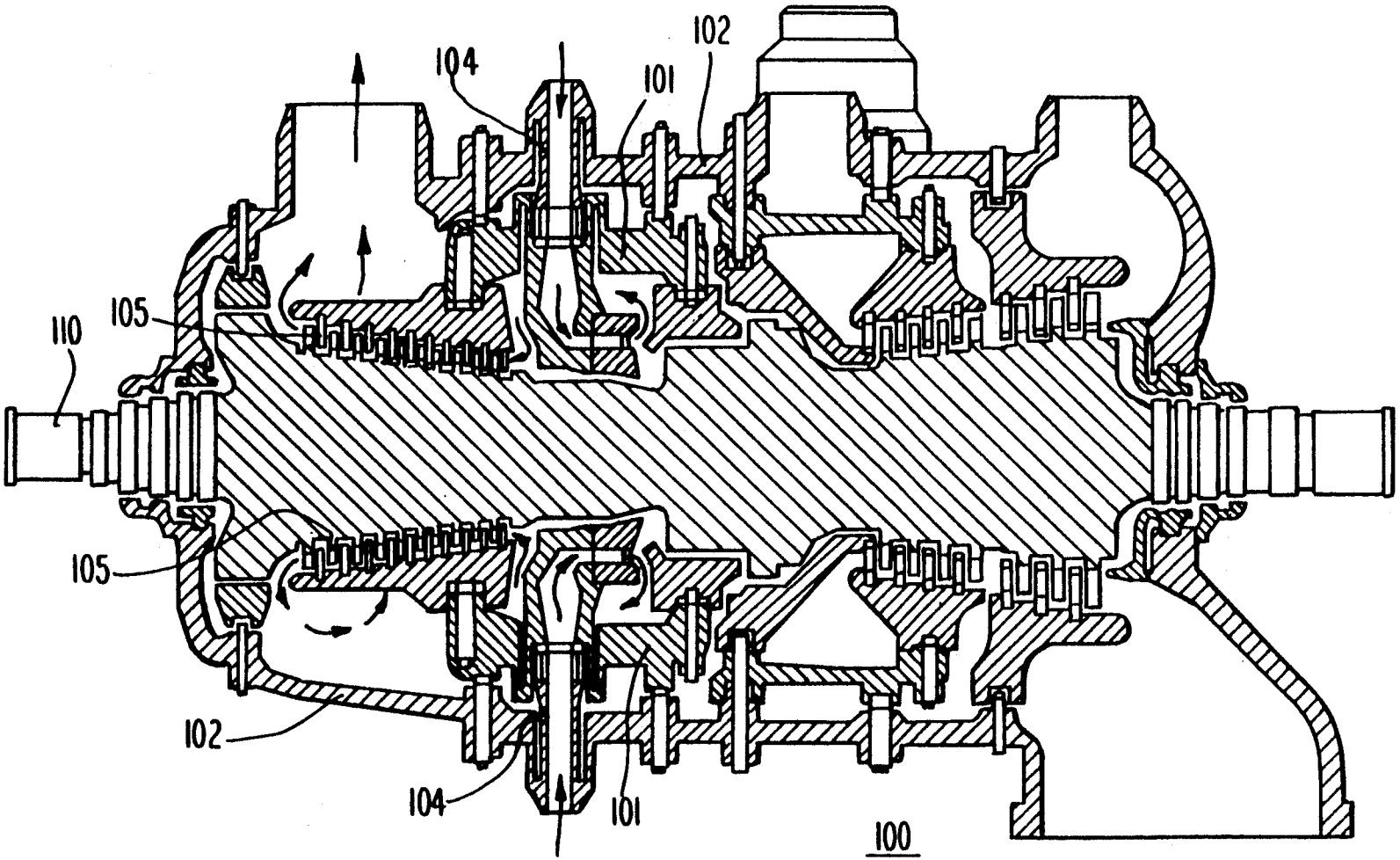
FIG. 1 is a cross-sectional view of a typical fossil steam turbine.
Figure 2:
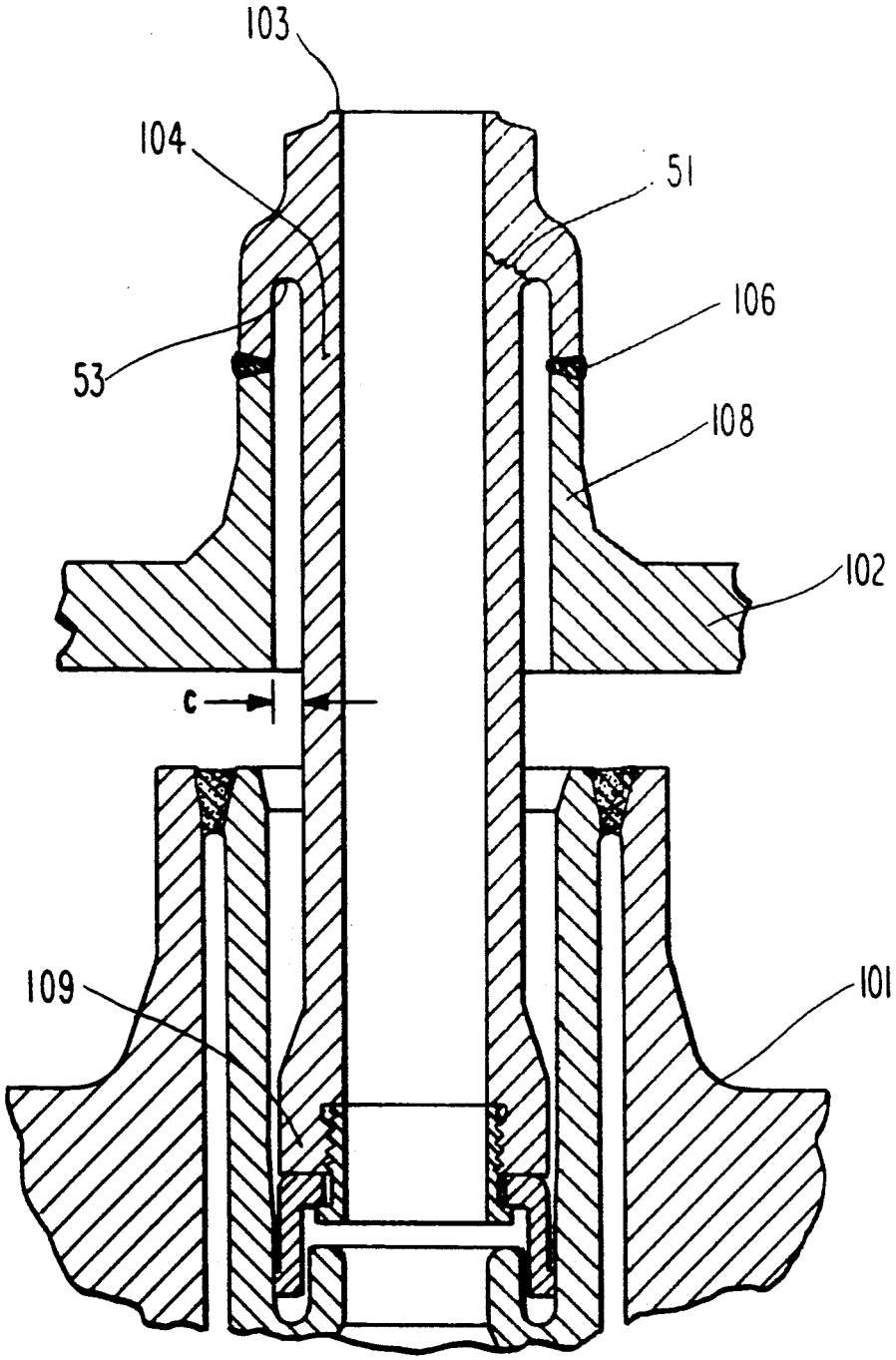
PRIOR ART Fig. 2
FIG. 2 is a cross-sectional view of a conventional connection between the inlet sleeve and outer cylinder of a steam turbine.
Figure 3:
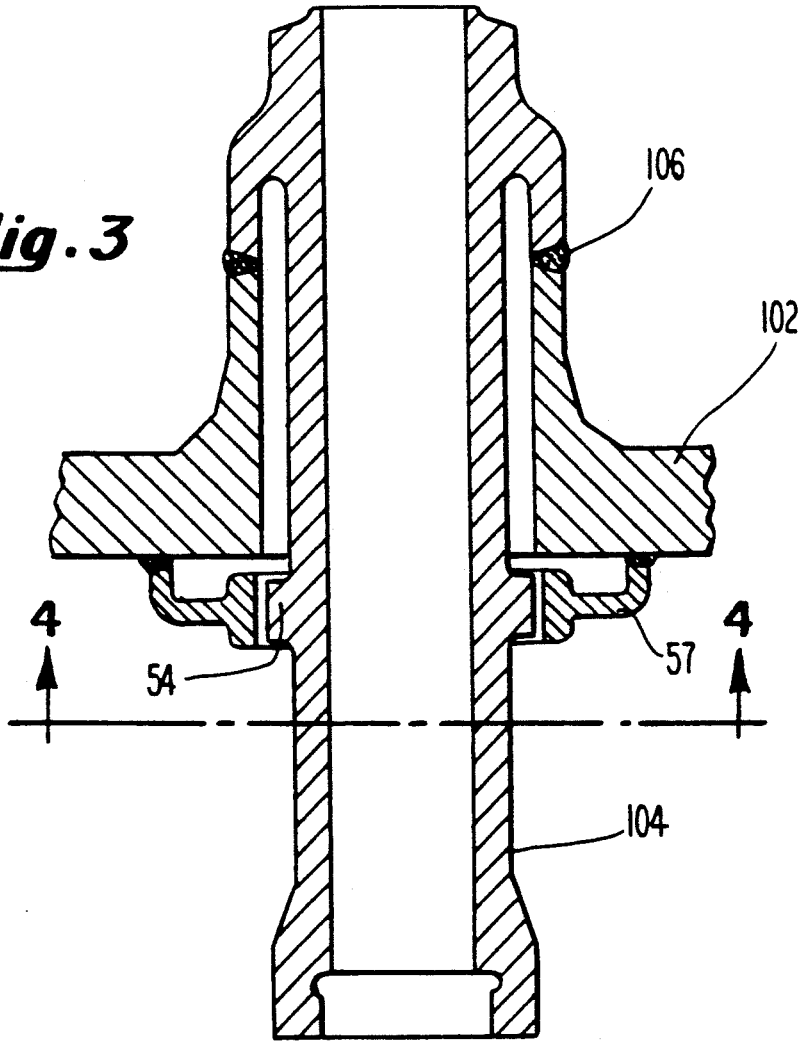
FIG. 3 is a cross-sectional view, similar to that shown in FIG. 2, of an improved connection between an inlet sleeve and an outer cylinder in accordance with the present invention.
Figure 4:
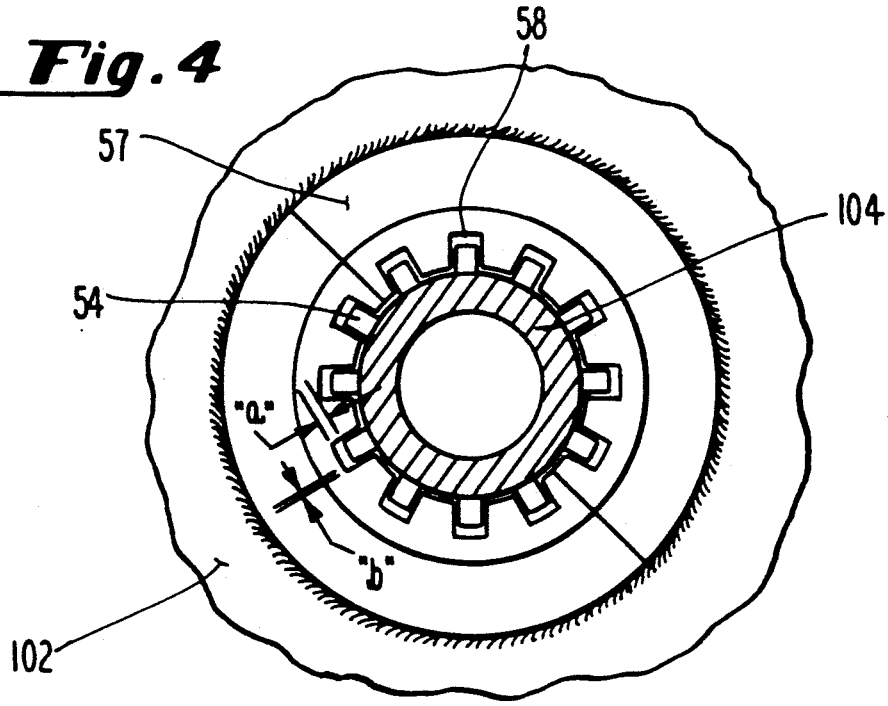
FIG. 4 is a partially broken-away end view of the connection shown in FIG. 3.

FIGS. 3 and 4 illustrate a preferred embodiment of the present invention. Most preferably, a disc 57 is installed in two halves, welded to the outer cylinder 102 after the inlet sleeve 104 is attached by a weld 106. FIG. 4 illustrates the preferred arrangement of evenly spaced splines 54 made integral with the inlet sleeve 104. The splines 54 nest in grooves 58, cut in the restraining disc structure 57. The size of the grooves 58 provides adequate cold radial clearance for installation ease, typically about 0.030", as shown by dimension "a" in FIG. 4. This clearance also permits the radial thermal expansion of the inlet sleeve 104. Vertical movement parallel to the sleeve axis is therefore not substantially restricted, however, oscillating movement in any direction is minimized by choosing a tighter cold circumferential clearance, e.g., about 0.002"–0.003", as shown by dimension "b". When steam is admitted to the turbine 100, each spline 54 will expand both radially and circumferentially. Since the inlet sleeve 104 will be at a higher temperature than the disc 57 due to its intimate contact with the steam, the expansion of the splines 54 will be greater than that of the grooves 58. For this reason, the circumferential clearance "b" will be substantially reduced. Due to the orientation of the splines 54, this dramatic reduction of the circumferential clearance "b" will effectively limit the vibration in all directions of the inlet sleeve 104.

Thus, the present invention prevents inlet sleeve cracking from high cycle fatigue by substantially eliminating the excessive vibration which is its fundamental cause. The multiple splines 54 and grooves 58 of the preferred embodiment of the present invention provide a means to limit the amplitude of the vibrations of the inlet sleeve 104 in all directions. This is a particularly beneficial feature of the present invention, since the direction of vibration is random. The splines 54 and grooves 58 and other restraining means of the present invention limit inlet sleeve 104 vibration to small amplitudes, resulting in the maximum alternating bending stresses in the inlet sleeve being well below the endurance limit of the material. This reduction of stress in turn reduces the likelihood of fatigue cracking.

Additionally, the design of the present invention does not introduce undesirable thermal stresses between the components which comprise the joint, but instead permits a sufficient thermal expansion during operation to prevent sleeve fracture. The preferred embodiments described above can expand freely in the radial direction and permit unrestricted axial expansion. These same structural members incorporate adequate cold clearance for ease of installation. The inlet sleeve 104 is positively attached by a weld 106 to the outer cylinder 102 to prevent the leakage of steam to the atmosphere. As explained above, the free end of the inlet sleeve 104 cannot be connected to the inner cylinder 101, since the temperature differential will induce thermal stress. The present invention provides an effective solution to the problems described above, since vibration is restrained in every direction while expansion and contraction due to heat transfer is not prevented.

The structure described above also admits to methods for assembling steam turbine assemblies. Using the present invention, it is now possible to provide splines 54 or similar means upon the inlet sleeve 104 and to affix a restraining structure such as the disc 58 to the outer cylinder 102. The inlet sleeve 104 is then assembled into the outer cylinder by sliding the cooperating splines and grooves 54, 58 together and connecting the inlet cylinder to the source of steam.

Although the preferred embodiments of the present invention have been described with particularity, numerous variations and modifications will immediately present themselves to those of ordinary skill upon review of the specification. Accordingly, reference should be made to the appended claims in order to determine the scope of the present invention.

I claim:

1. A steam turbine comprising:

an outer cylinder and an inlet sleeve for receiving and transmitting steam;

a restraining structure affixed to the outer cylinder having a radial dimension and an inner and an outer circumferential dimension; and one or more spline means for cooperating with the restraining structure affixed to the inlet sleeve and adapted to be disposed within the restraining structure within a tolerance, whereby the inlet sleeve is substantially restrained from radial oscillation in all directions by a relatively small tolerance between the inner circumferential dimension of the restraining structure and the spline and unrestrained from axial movement and thermal expansion.

2. The steam turbine of claim 1, wherein the restraining structure comprises one or more grooves oriented along the axis of the inlet sleeve.

3. The steam turbine of claim 2, wherein said grooves are substantially square.

4. The steam turbine of claim 2, wherein the restraining structure comprises a disc having an inner edge comprising a plurality of circumferentially disposed axial grooves and an outer edge affixed to the outer cylinder.

5. The steam turbine of claim 4, wherein the spline means for engaging the restraining structure comprises one or more splines which cooperate with the grooves to form a sliding fit therewith.

6. The steam turbine of claim 5, wherein the inlet sleeve has an outer surface, and one or more of the splines are disposed circumferentially upon the outer surface of the inlet sleeve.

7. The steam turbine of claim 1, wherein the tolerance of the radial dimension and the inner circumferential dimension relative to the second restraining means is less than about 0.003 inches (0.08 mm) and the tolerance between the outer circumferential dimension and the second restraining means is at least about 0.030 inches (0.76 mm).

8. A steam turbine comprising an outer cylinder comprising a first restraining means having a radial dimension and an inner and an outer circumferential dimension, and an inlet sleeve for receiving steam comprising a second restraining means adapted to be disposed within the first restraining means within a tolerance, wherein said second restraining means comprises one or more splines oriented along the axis of the inlet sleeve, whereby the inlet sleeve is restrained from substantial radial oscillation in all directions by a relatively small tolerance between the inner circumferential dimension of the first restraining means and the second restraining means, and the inlet sleeve is substantially unrestrained from axial motion and thermal expansion by the tolerance between said outer circumferential and radial dimensions of the first restraining means and the second restraining means.

9. The steam turbine of claim 8, wherein the splines are substantially square.

10. The steam turbine of claim 8, wherein the first restraining means comprises a disc having an inner edge comprising a plurality of circumferentially disposed axial grooves, the disc having an outer edge affixed to the outer cylinder.

11. The steam turbine of claim 10, wherein the first restraining means comprises one or more splines which cooperate with the grooves to form a sliding fit therewith.

12. The steam turbine of claim 11, wherein the inlet sleeve has an outer surface, and one or more of the splines are disposed circumferentially upon the outer surface of the inlet sleeve.

13. The steam turbine of claim 8, wherein the tolerance of the radial dimension and the inner circumferential dimension relative to the second restraining means is less than about 0.003 inches (0.08 mm) and the tolerance between the outer circumferential dimension and the second restraining means is at least about 0.030 inches (0.76 mm).

* * * * *